United States Patent [19]

Jencks et al.

[11] 4,166,262

[45] Aug. 28, 1979

[54] SOLENOID

[75] Inventors: Hollis W. Jencks; David C. Jencks, both of Pleasant Ridge, Mich.

[73] Assignee: Detroit Coil Company, Ferndale, Mich.

[21] Appl. No.: 741,983

[22] Filed: Nov. 15, 1976

[51] Int. Cl.[2] ..... H01F 7/10

[52] U.S. Cl. ..... 335/251; 335/262; 75/246

[58] Field of Search ..... 335/245, 248, 251, 255, 335/260, 262, 278–280, 282, 299; 336/133, 198; 75/246

[56] References Cited

U.S. PATENT DOCUMENTS

| | | | |
|---|---|---|---|
| 2,482,860 | 9/1949 | Miller | 335/245 |
| 2,539,285 | 1/1951 | Thompson | 336/233 X |
| 3,082,359 | 3/1963 | Mangiafico et al. | 335/260 X |
| 3,201,729 | 8/1965 | Blanchi et al. | 335/278 X |
| 3,566,323 | 2/1971 | Graf et al. | 335/297 X |
| 3,837,618 | 9/1974 | Juhel | 335/255 X |
| 4,054,854 | 10/1977 | Marsden | 335/255 |
| 4,069,043 | 1/1978 | Ackermann | 75/246 X |

OTHER PUBLICATIONS

Treatise on Power Metallurgy, vol. II, 1950, pp. 283–287, Interscience Publishers, Inc., New York, 1950.

*Primary Examiner*—George Harris

*Attorney, Agent, or Firm*—Burton, Parker & Schramm

[57] ABSTRACT

An alternating current solenoid having a quadrilateral frame and coil wound plastic bobbin disposed therein is encapsulated in a resin block with a pole piece extending into the block and through the frame at one end, and a plunger in a guideway formed by the barrel of the bobbin reciprocates through the other end of the frame and within the guideway.

1 Claim, 12 Drawing Figures

SOLENOID

FIELD OF INVENTION

This invention relates to an improved alternating current solenoid.

BACKGROUND OF THE INVENTION

U.S. Pat. No. 3,605,054 discloses an encapsulated solenoid which marked a substantial improvement over prior art solenoids by eliminating a number of parts and assembly operations, improved heat transfer to the ambient atmosphere, and the resin block encapsulating the parts was of sufficient structural integrity so that the solenoid could be secured directly to the device to be actuated by securing the block itself to such device. While such solenoid has been enjoying substantial commercial success, further attention has been given to reducing manufacturing and assembly costs.

It has long been an object in the design of solenoids to improve mechanical reliability and reduce manufacturing costs. To reduce eddy current losses it is common practice in industrial solenoids to fabricate the field frame (or stack) and plunger from a series of steel laminations riveted together. A typical solenoid of this construction is shown in U.S. Pat. No. 2,466,592. Such solenoids, though quite efficient, necessitate providing a series of laminations which must be riveted together and this raises the manufacturing cost over parts that are non-laminated. However, solid (non-laminated) parts increase current losses and therefore the problem is to arrive at a design which will minimize such losses at the lowest possible manufacturing cost.

One approach to eliminating the riveted laminations of the field stack is shown in U.S. Pat. No. 2,629,766 wherein the field stack comprises a spirally wound strip of steel having a central opening in which is inserted a coil. Being wound upon themselves the convolutions of the stack need not be riveted together. There is a metal tube within which the plunger reciprocates. The metal tube increases the air gap and reduces solenoid efficiency as well as contributing to unit cost.

In U.S. Pat. No. 3,633,139 an arrangement generally similar to U.S. Pat. No. 2,629,766 is shown but the solenoid coil and spirally wound stack (or frame) are encapsulated in a resin block. Here a solid plunger is utilized and a longitudinal slot is provided therein for reducing eddy current losses. In this patent as in U.S. Pat. No. 2,629,766 a metal plunger tube extends completely through the structure and this increases the air gap and reduces efficiency as well as increasing unit costs.

SUMMARY OF THE INVENTION

We have discovered that a solenoid can be constructed which utilizes fewer parts than any of those mentioned, or any of which we are aware, whose cost as compared to the construction shown in U.S. Pat. No. 3,633,139 will be substantially reduced (as much as 40 percent) and whose efficiency will be better than the solenoids of either U.S. Pat. Nos. 2,629,766 and 3,633,139. For example, compared with the solenoid shown in U.S. Pat. No. 3,633,139 the force developed in such solenoid by 19–20 watts at ⅛" stroke or more can be developed in our improved solenoid with but 14–16 watts, or for only about 75 percent of the power. While our new solenoid is not quite as efficient as the construction shown in U.S. Pat. No. 3,605,054, it reduced cost (up to 40 percent) and simplicity, and high order of mechanical reliability, should more than offset this.

BRIEF DESCRIPTION OF PREFERRED EMBODIMENTS

Figure 1:
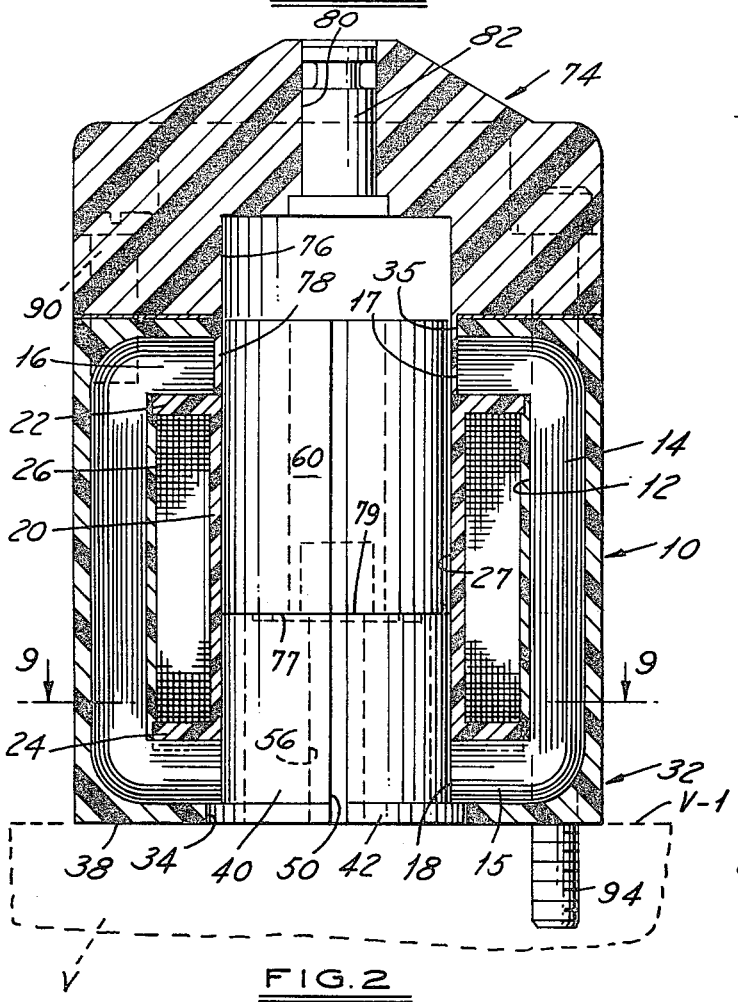
FIG. 1 is a cross-sectional view through a push-type alternating current solenoid embodying our invention taken on the Line 1—1 of FIG. 2.
Figure 3:
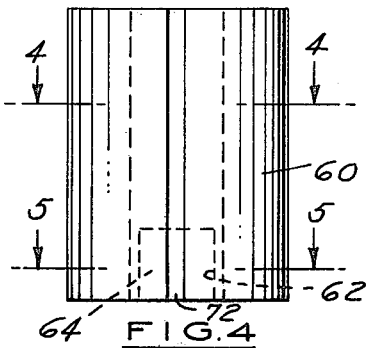
FIG. 3 is a side elevation of the plunger of the solenoid.
Figure 8:
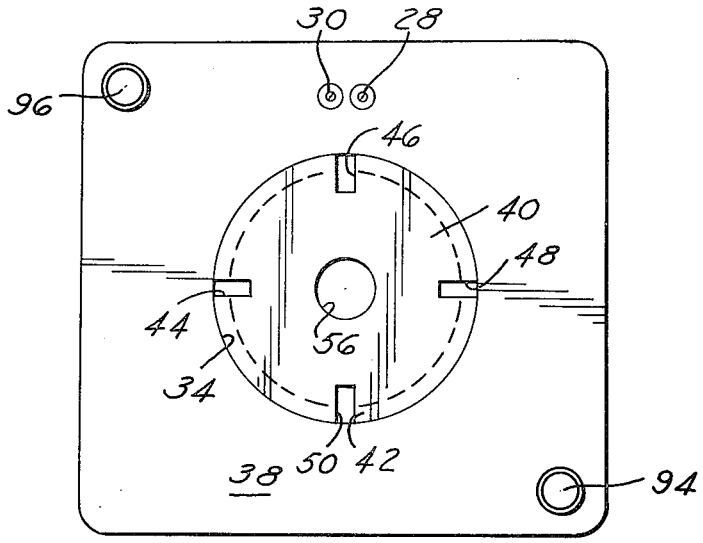
FIG. 8 is a bottom view of the solenoid shown in FIG. 1.
Figure 9:
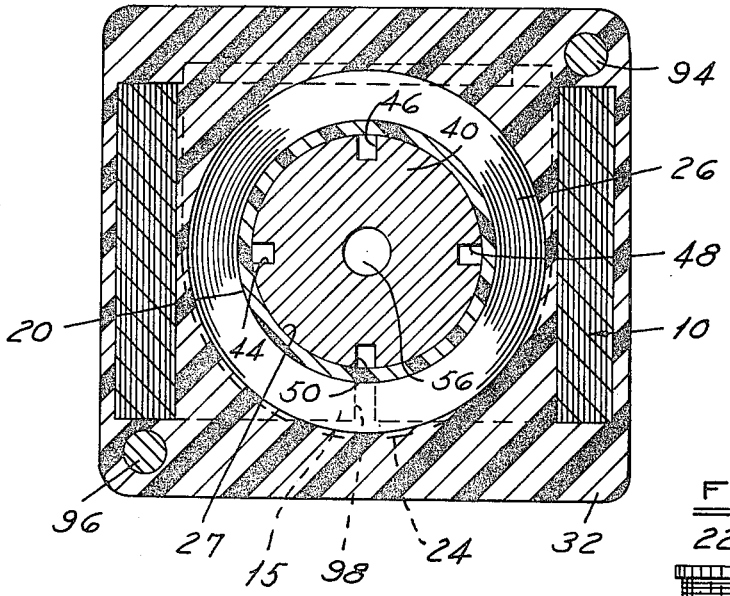
FIG. 9 is a cross-sectional view taken on the Line 9—9 of FIG. 1.
Figure 10:
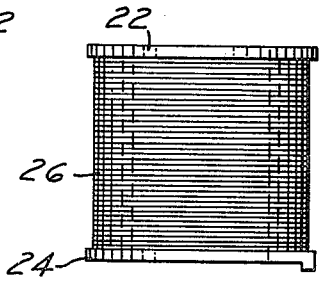
FIG. 10 is a side elevation of a coil wound bobbin for use in the solenoid.

Our improved solenoid comprises a rectangular or quadrilateral frame 10 shown in FIGS. 1 and 9 having a central coil opening 12 formed by wrapping a ribbon of silcon steel 14 upon itself through a number of convolutions. A pair of opposite sides 15 and 16 are provided with centrally arranged, opposed, aligned apertures 17 and 18 extending from the opening 12 completely through the convolutions. A coil wound plastic bobbin shown in FIG. 10 is received in the central opening 12 of the frame. The bobbin is preferably formed of nylon, though other suitable plastics may be utilized. It has a cylindrical barrel portion 20 and opposed integral end flanges 22 and 24 between which the coil 26 is wound. The interior of the barrel defines a plunger guideway 27 which is aligned with the apertures 17 and 18 of the frame. The magnet wire comprising the coil extends to and terminates at electric terminal pins 28 and 30 (see FIG. 8) for connection in complementary female sockets on the device to be actuated similar to the arrangement shown in FIGS. 13 and 14 of U.S. Pat. No. 2,975,340.

The frame 10, coil wound bobbin, and terminal pins are all integrated in a single structural assembly by encapsulation in a resin block 32. Such encapsulation may be effected by transfer molding, vacuum molding, or simple casting, utilizing a conventional epoxy resin which may be either a casting or molding resin containing a mineral filler. While an epoxy resin has been mentioned, any resin having the requisite structural integrity, thermal conductivity and heat resistivity to withstand continuous operation of the solenoid, may be utilized. The encapsulation should be accomplished in such fashion as to cause the resin to enter all the interstices between the various surfaces of the parts to provide a strong, well-supported, block-like structure.

At the time of casting the block 32 the apertures 17 and 18 of the frame are plugged as is the plunger guideway 27 to prevent the casting resin from covering the surfaces thereof. Furthermore, the casting or molding operation should provide for the forming of cylindrical opening 34 larger than but concentric with aperture 18 and communicating between the adjacent side 15 of the frame, around the aperture 18, and the outside bottom surface 38 of the block. An opening 35 through the opposite end of the block is aligned with the aperture 17 and is of equal diameter therewith.

A cylindrical, solid (non-laminated), pole piece or stop 40 is press-fitted into the aperture 18 of the frame to make snug contact with the frame. A flange 42 on the lower end of the pole piece fits within the opening 34 to abut the frame side 15 and lie flush with the bottom surface 38 of the block. The other end of the pole piece projects into the plunger guideway 27.

The pole piece is provided with a plurality of longitudinally extending slots 44–50 for the purpose of reducing eddy current losses. Its upper or inner end 52 is provided with an annular concentric groove spaced from the slots 44–50. In such groove a shading coil 54 of copper is brazed or otherwise suitably fixed in place. The pole piece is also shown as being provided with an axial bore 56 for receiving a push-pin (not shown) for transmitting motion between the solenoid plunger and the device to be actuated.

Figure 4:
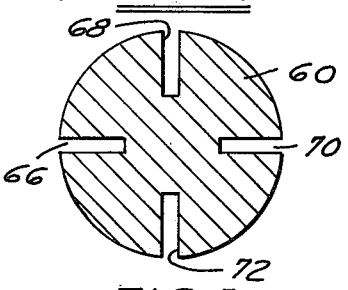
FIG. 4 is a cross-sectional view of the plunger taken on the Line 4—4 of FIG. 3.
Figure 5:
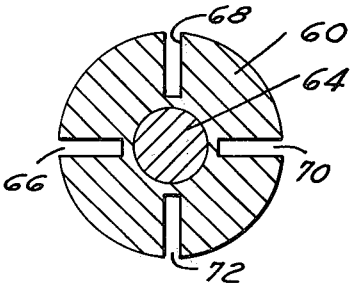
FIG. 5 is a cross-sectional view of the plunger taken on the Line 5—5 of FIG. 3.
Figure 2:
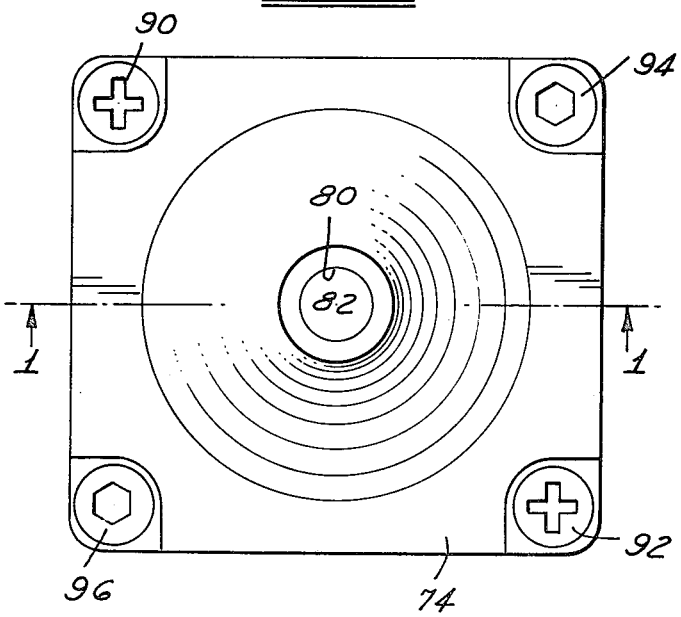
FIG. 2 is a top plan view of the solenoid shown in FIG. 1.
Figure 6:
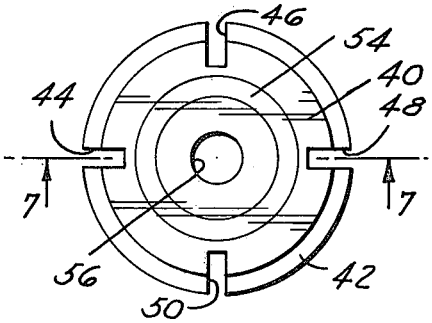
FIG. 6 is a top plan view of the pole piece of the solenoid.
Figure 7:
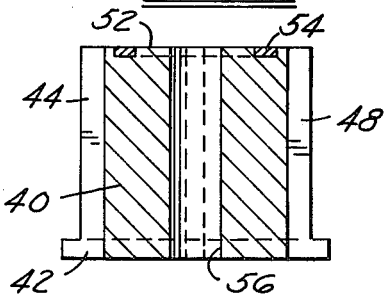
FIG. 7 is a cross-sectional view of the pole piece taken on the Line 7—7 of FIG. 6.

Supported in the guideway 27 for reciprocal movement is a solid (non-laminated), cylindrical solenoid plunger 60. The plunger may be provided with a central cylindrical pocket 62 in which is secured by brazing or in any other suitable fashion a tool steel anvil 64 for abutting the upper end of the aforementioned push-pin. The plunger is also provided with a plurality of longitudinally extending slots 66–72 as best shown in FIGS. 4 and 5 for reducing eddy current losses and also equalizing pressures at opposite ends of the plunger during rapid shifting thereof.

The plunger may be a sintered metal part, and preferably is so formed. It should have a density of at least 80 percent and desirably higher such as above 85 percent. Utilization of recent developments in powder metal technology leading to densities of 99 percent+would be most desirable as the higher density reduces magnetic flux losses. A typical composition, by weight, of the plunger may comprise:

3 percent Silicon
97 percent Iron

The iron may include: 0.01 percent phosphorus, 0.015 percent sulfur, 0.025 percent magnesium, 0.010–0.015 percent carbon, and the balance iron.

The pole piece 40 may also be formed of powder metal if a sufficiently high density is provided, such as 95 percent+. The density should be sufficiently high so that the shading coil 54 may be brazed to the pole piece with a good bond therebetween. A powder metal pole piece so formed may have a metallurgical composition corresponding to that of the plunger, above noted.

The upper end of the block 32 is provided with a cap 74 formed of nylon or any suitable plastic. The cap is provided with an internal pocket 76 coaxially aligned with the plunger guideway 27. Sleeve means 78 is also provided which fits closely within the aperture 17 of the frame and has an internal diameter corresponding to that of the guideway 27 and the pocket 76 whereby it forms smooth continuation of the guideway 27 into the pocket 76 and prevents the plunger from wiping the edges of the frame at the aperture 17. Such sleeve means may comprise an integral depending skirt on the cap which is molded therewith of the same or different material than the cap. The sleeve may be formed of nylon. Such sleeve means is relatively thin walled, as shown, thereby reducing the air-gap between the plunger and frame at the aperture 17.

The cap is further provided with a central bore 80 for receiving the manual actuating pin 82 similar to that shown in U.S. Pat. No. 3,605,054.

As the plunger is supported by the guideway 27 in the bobbin barrel and the thin wall sleeve means 78 of the cap, only a minimum air-gap consistent with the smooth sliding action exists between the plunger and the upper side 16 of the frame. The principle air-gap will be the working gap created between the confronting ends 77 and 79 of the plunger and pole piece when the plunger is shifted upwardly away from the pole piece as by the upward force of the push-pin thereagainst.

The cap is retained on the block by four bolts or the like 90, 92, 94, and 96 which extend into suitable apertures in the cap and into the block 32. Of these, bolts 90 and 92 are threaded into the block to retain the cap by direct securement to the block while the bolts 94 and 96 extend through passageways completely through the block and project beyond the lower surface 38 thereof for threaded engagement with the device V (shown in phantom outline) to be actuated for securing the solenoid thereto.

Both sides of the frame 15 and 16 may be provided with a transverse slot, as for example a slot 98 shown in FIG. 9 through the side 15 of the frame, which extends from one edge of the frame to the central apertures 17 and 18. Such slots will reduce eddy current losses in the frame 10.

It will be noted that when the solenoid is secured to the device to be operated, the wide flanged end 42 of the pole piece will be sandwiched between the frame end 15 and a surface V-1 of the device, and that as the end 77 of the plunger strikes the pole piece the force will be transmitted, not to the solenoid, but to the surface of the device to be operated. Unlike the structure in U.S. Pat. No. 3,633,139, all forces are transmitted in a compression mode directly to the device to be actuated, rather than in shear.

The selection of nylon for the bobbin results in a plunger guideway having a low coefficient of friction so the plunger may reciprocate freely therein. Should operating temperatures exceed safe limits for nylon, then a thermosetting plastic of suitable toughness, low coefficient of friction and good wearability may be used.

Unlike prior art constructions wherein a continuous metal tube extends through the coil and frame either effectively provides a shorted turn thereby increasing wattage or increases the air gap, the absence of such tube in the present construction and the positioning of the pole piece and the snug fit thereof in one side of the frame, together with only a thin air gap between the plunger and opposite side of the frame, promotes good magnetic efficiency. Losses are also reduced, of course, by the provision of the slots in the pole piece, plunger, and frame.

Figure 11:
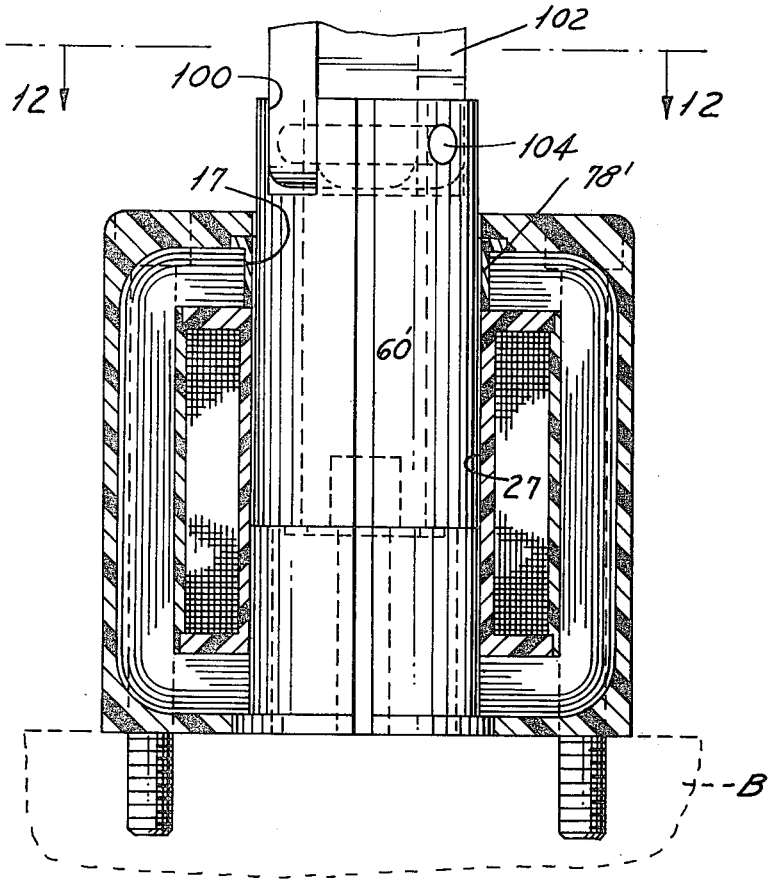
FIG. 11 is a cross sectional view through a pull type alternating current solenoid embodying the invention.
Figure 12:
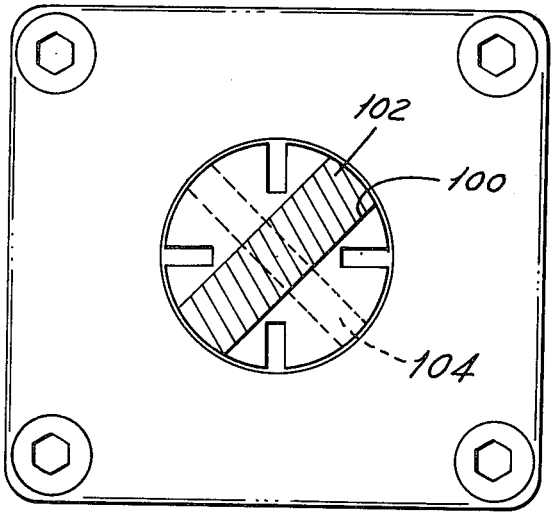
FIG. 12 is a cross sectional view taken on the Line 12—12 of FIG. 11.

In FIGS. 11 and 12 we have shown a pull-type solenoid embodying the invention. The solenoid corresponds in all respects to that heretofor described except for the following. The cap 74 has been eliminated and a sleeve 78' formed of nylon or other suitable plastic material is inserted in the aperture 17 of the frame prior to encapsulation to form a smooth continuation of the guideway 27. The plunger 60' is somewhat larger and the upper end is transversely slotted at 100 to form an upwardly opening recess within which a link 102, rectangular in cross-section, is pivotally mounted on a transverse pin 104 extending through the plunger. The link is operatively connected to the device to be actuated (not shown). B represents a mounting base for the solenoid.

It will be apparent from the foregoing description that instead of a cylindrical plunger guideway 27 the bobbin may have a square or rectangular barrel portion thereby permitting use of a correspondingly shaped plunger. Such a plunger may be made of steel laminations, if desired, to reduce eddy current losses. The pole piece 40 would, of course, be correspondingly shaped, and of laminated construction, or not, as desired. It is to be understood that such modifications would tend to increase costs of the solenoid.

What is claimed is:

1. An alternating current solenoid comprising, in combination:

a quadrilateral one piece frame having a central coil receiving opening with a pair of opposite sides having aligned apertures opening therethrough, a coil-wound plastic bobbin received in the central opening of the frame and having a barrel portion defining a cylindrical plunger guideway aligned with said apertures, said frame and coil-wound bobbin encapsulated in a resin block having openings through opposite ends thereof aligned with the apertures in the frame, a non-laminated, cylindrical pole piece received through one end of the block and extending in a press fit through one of said apertures in a side of the frame to make snug contact therewith and projecting into the plunger passageway, a closure cap removably overlying the opposite end of the block from the pole piece and internally provided with a cylindrical pocket aligned with the plunger guideway, means for removably securing said cap to the block in the aforesaid relation, a plastic thin walled skirt integral with said cap and concentric with the plunger passageway and telescoped through the frame aperture opposite the pole piece and forming a smooth continuation of the plunger passageway into the cap pocket, a non-laminated, cylindrical plunger received in the guideway and supported thereby for reciprocation toward and away from the pole piece, said plunger guideway of the bobbin barrel and said skirt and the wall of said cap pocket providing the sole support for guiding the plunger during said reciprocation with the pole piece and cap pocket limiting the opposite extremes of plunger movement, and said pole piece having a radially extending flange portion underlying said frame around the aperture through which the pole piece extends with said flange abuting the frame, said flange being outwardly exposed through the resin block to abut in a compression mode the surface of the device to be actuated, whereby when the block is mounted on such device the flange is sandwiched and retained between such device and the adjacent side of the frame.

* * * * *